US005638050A

United States Patent [19]

Sacca et al.

[11] Patent Number: 5,638,050

[45] Date of Patent: Jun. 10, 1997

[54] SYSTEM FOR LOCATING AN OBJECT

[75] Inventors: Frank Sacca, West Covina; Marcus Escobosa, Anaheim, both of Calif.

[73] Assignee: Universal Electronics, Inc., Twinsburg, Ohio

[21] Appl. No.: 581,447

[22] Filed: Dec. 29, 1995

[51] Int. Cl.[6] ..... G08B 13/181

[52] U.S. Cl. ..... 340/571; 340/539; 340/825.49; 455/231; 455/344; 455/899

[58] Field of Search ..... 340/571, 539, 340/825.49; 455/231, 344, 899

[56] References Cited

U.S. PATENT DOCUMENTS

| | | | |
|---|---|---|---|
| 4,101,873 | 7/1978 | Anderson et al. | 340/539 |
| 4,476,469 | 10/1984 | Lander | 340/825.49 |
| 4,959,810 | 9/1990 | Darbee et al. | 364/900 |
| 5,204,657 | 4/1993 | Prosser et al. | 340/825.49 |
| 5,294,915 | 3/1994 | Owen | 340/539 |
| 5,455,560 | 10/1995 | Owen | 340/539 |

*Primary Examiner*—Glen Swann

*Attorney, Agent, or Firm*—Mark R. Galis; Gary R. Jarosik; Thomas R. Vigil

[57] ABSTRACT

A system for locating an object, particularly a remote control, has a transmitter and a receiver, wherein the receiver has circuitry implementing power saving features. The receiver includes circuitry for turning off portions of the circuitry not essential for performing the current task. The receiver additionally only activates the wireless signal receiver portion of the circuitry periodically for short periods of time. The time of activation represents a small fraction of the operational time if the wireless signal receiver portion were to remain activated continuously.

12 Claims, 4 Drawing Sheets

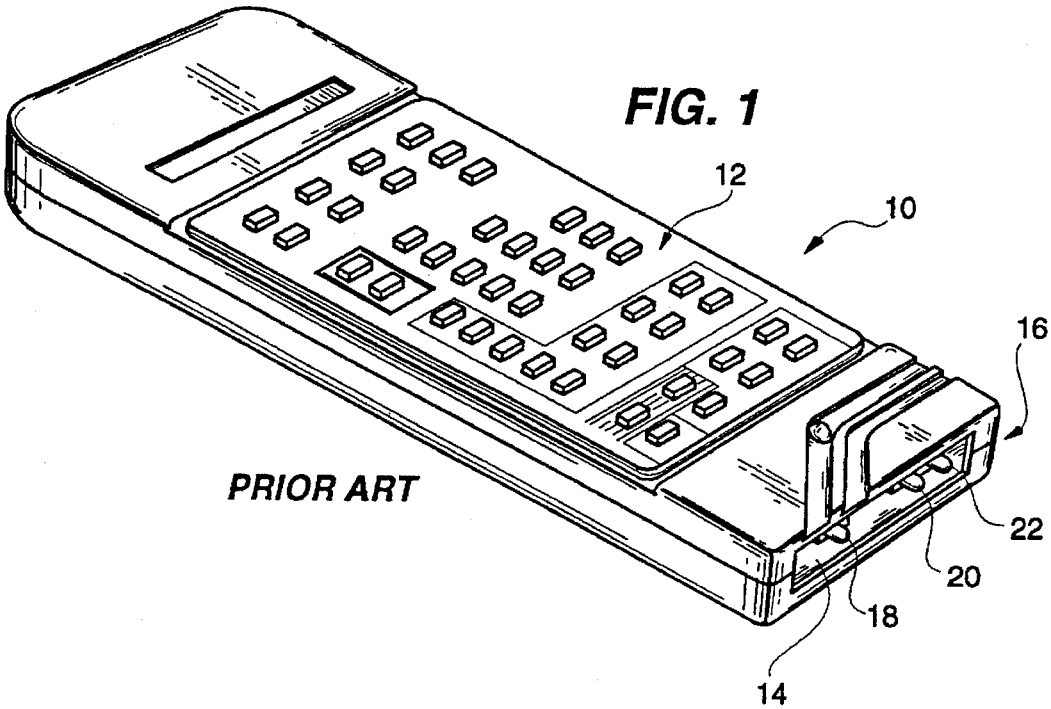
FIG. 1
PRIOR ART
FIG. 2
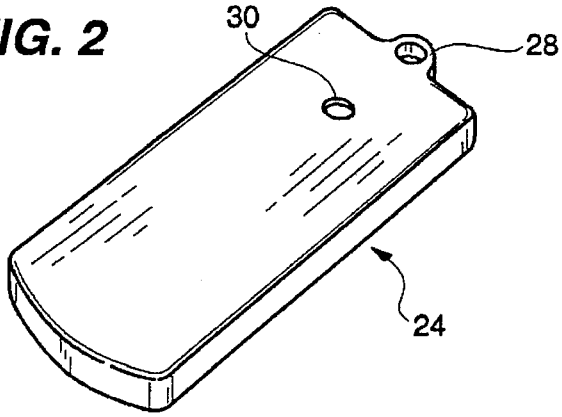
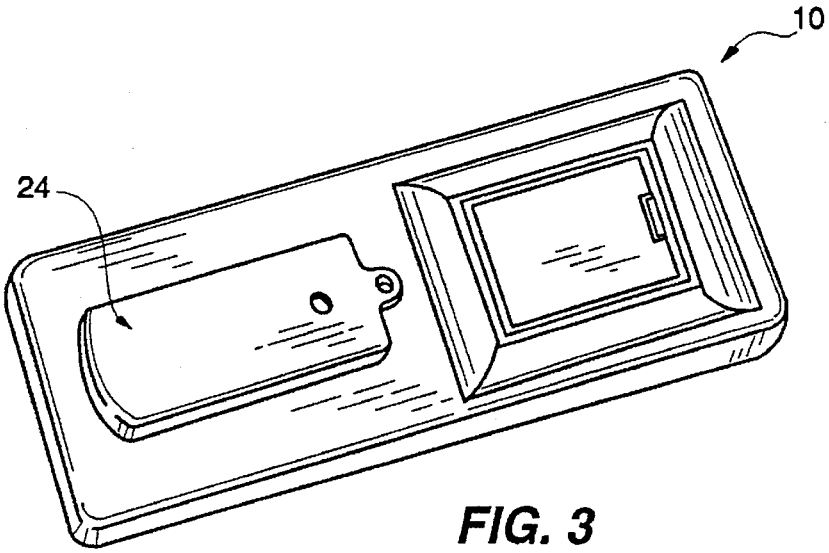
FIG. 3

SYSTEM FOR LOCATING AN OBJECT

BACKGROUND OF THE INVENTION

Field of the Invention

The present invention relates to a system for locating an object, particularly a remote control, having circuitry implementing power saving features.

Description of the related art including information disclosed under 37 CFR §§1.97–1.99.

Heretofore, various systems for locating a lost or misplaced object have been proposed. Several examples of analogous and non-analogous systems for locating an object are disclosed in the following U.S. Patents:

| U.S. Pat. No. | Patentee |
|---|---|
| 4,101,873 | Anderson et al. |
| 4,476,469 | Lander |
| 4,507,653 | Bayer |
| 5,204,657 | Prosser |
| 5,294,915 | Owen |

The Anderson et al., U.S. Pat. No. 4,101,873 discloses a device to locate commonly misplaced objects including a transmitter and multiple receivers. The multiple receivers selectively generate an audible signal upon receipt of a corresponding combination of tone signals. Each receiver has a motor-driven switch for activating a portion of the receiver circuit for only a fraction of every second. The motor-driven switch runs continuously.

The Lander, U.S. Pat. No. 4,476,469 discloses a means for assisting in locating an object including a transmitter and a transponder. The transponder is attached to the object to be located and emits an audible sound when the transponder receives a signal containing a corresponding binary coded address from the transmitter.

The Bayer, U.S. Pat. No. 4,507,653 discloses an electronic sound detecting unit for locating missing articles including a miniature electronic unit to be attached to the object to be located. The miniature electronic unit is responsive to an audible human generated sound following a set pattern. The miniature electronic unit responds by emitting an audible sound the user can use to trace the location of the missing article. The unit provides for periods of shut down when located in a noisy environment that produces sound patterns that do not follow the set activation pattern.

The Prosser, U.S. Pat. No. 5,204,657 discloses a locating device attached to or incorporated in an object like a remote control and a base. The object resides within the base when the object is not in use. When the object is away from the base for a defined period of time the locating device emits an audible signal to allow the user to home in on the object. The locating device is only active when the object is removed from the base.

The Owen, U.S. Pat. No. 5,294,915 discloses a means for locating a remote control device including a receiver and a transmitter. The receiver is built into and hard wired into a remote control. The transmitter is built into the device to be controlled by the remote control. When the transmitter is activated by pressing the manually actuated switch, the receiver emits an audible signal for assisting in the location of the remote control.

SUMMARY OF THE INVENTION

According to the present invention there is provided a system for locating an object, particularly a remote control, having circuitry implementing power saving features. The system includes both a transmitter and a receiver. The transmitter broadcasts a transmitted signal for a fixed duration of time when the user activates a manually actuated button. The receiver is attached to the object to be located and contains an audible signal generator circuit for emitting an audible signal when the receiver detects the transmitted signal from the transmitter. The audible signal assists the user in tracing the sound back to the source of the audible signal and locating the lost object.

The size of the receiver is sufficiently small to be unobtrusively attached to various different types of objects. The receiver is primarily designed to be attached to a remote control, however the receiver could be similarly attached to a key ring, a cordless phone, eye glasses or many other types of objects that have the potential to be lost or misplaced. In order to be attached with as many different types of objects without interfering with the normal use of the object, the size of the receiver is kept to a minimum.

The receiver includes power management circuits to reduce power consumption of the receiver and allow for the use of a smaller battery. The receiver includes a wireless signal receiver circuit, that is normally inactive, and is only activated periodically for short periods of time. The period of time the wireless signal receiver circuit is inactive is less than the fixed duration of the transmitted signal emitted by the transmitter. By making the period of inactivity of the wireless signal receiver circuit of the receiver shorter than the fixed duration of the transmitted signal, the wireless signal receiver circuit of the receiver will be active for a portion of the time the transmitted signal is emitted.

The receiver further manages power consumption by deactivating unnecessary circuitry when an audible signal is generated. When the transmitted signal emitted by the transmitter is detected by the receiver, the control circuit of the receiver activates an audible signal receiver circuit and turns off all of the circuitry not required to operate the audible signal receiver circuit including the wireless signal receiver circuit and the wake up timer circuit. By managing power consumption, smaller batteries can be used and or the battery of the receiver will operate for an extended life.

Other objects and advantages of the present application will be apparent from the detailed description and drawings which follow.

BRIEF DESCRIPTION OF THE DRAWINGS

FIG. 1 is a front perspective view of a remote control of the prior art.

FIG. 2 is a perspective view of a receiver to be attached to the object that may potentially become lost or misplaced.

FIG. 3 is a perspective view of the receiver shown in FIG. attached to the back of the remote control shown in FIG. 1.

DESCRIPTION OF THE PREFERRED EMBODIMENT

Figure 4:
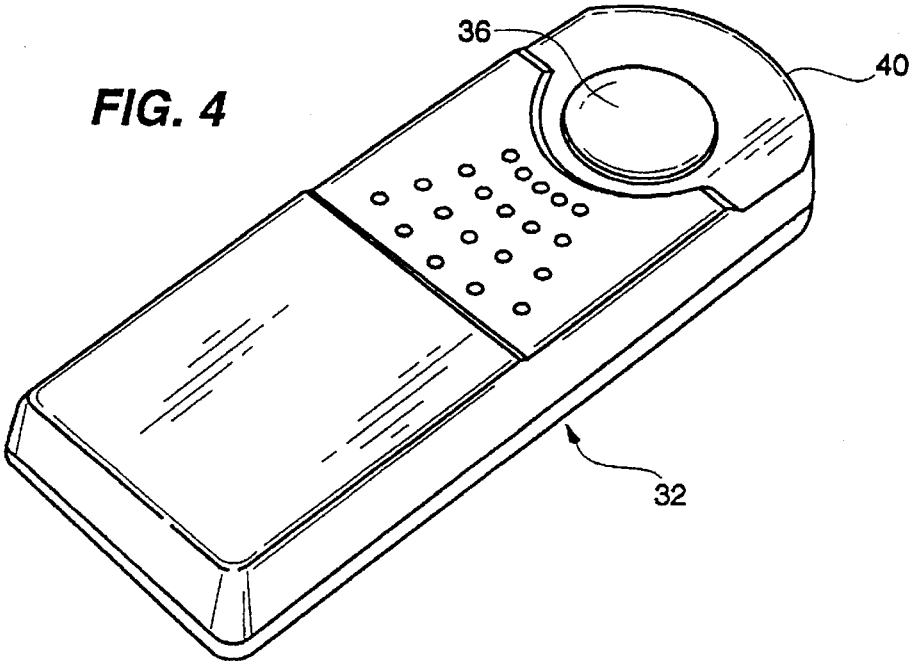
FIG. 4 is a perspective view of a transmitter that is used to signal the receiver, shown in both FIGS. 2 and 3, to emit an audible signal.

Referring now to the drawings in greater detail, there is illustrated in FIG. 1 a front perspective view of a remote control 10 of the prior art. The remote control 10 is of the type disclosed in U.S. Pat. No. 4,959,810, the disclosure of which is incorporated herein by reference.

The remote control 10 includes a key pad 12 having a plurality of keys thereon for operating the remote control 10. The remote control 10 is generally rectangular in shape and has a window 14 at one end 16. As shown, three light emitting diodes 18, 20 and 22 are mounted in the window 14.

The remote control 10 provides a point of reference as to one of the objects the system for locating an object can be used to assist in locating. The system for locating an object can similarly be used to locate a ring of keys, a cordless phone, eye glasses or many other types of objects that have the potential to be lost or misplaced.

Figure 5:
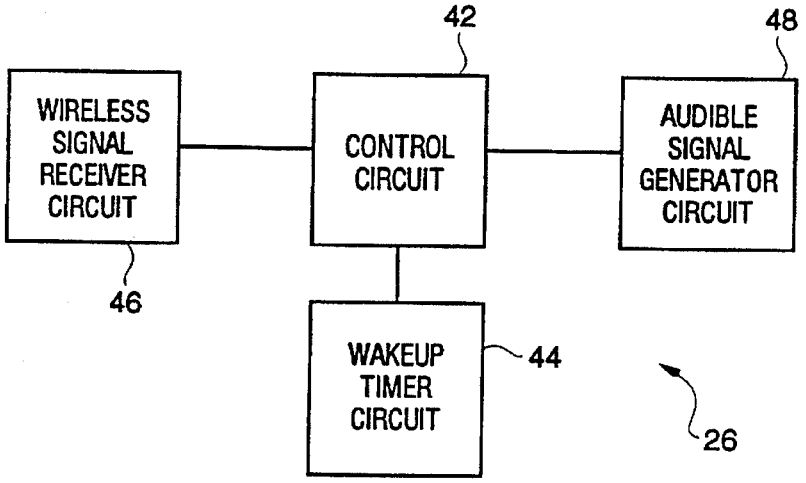
FIG. 5 is a block diagram of the internal circuitry of the receiver shown in FIGS. 2 and 3.
Figure 6:
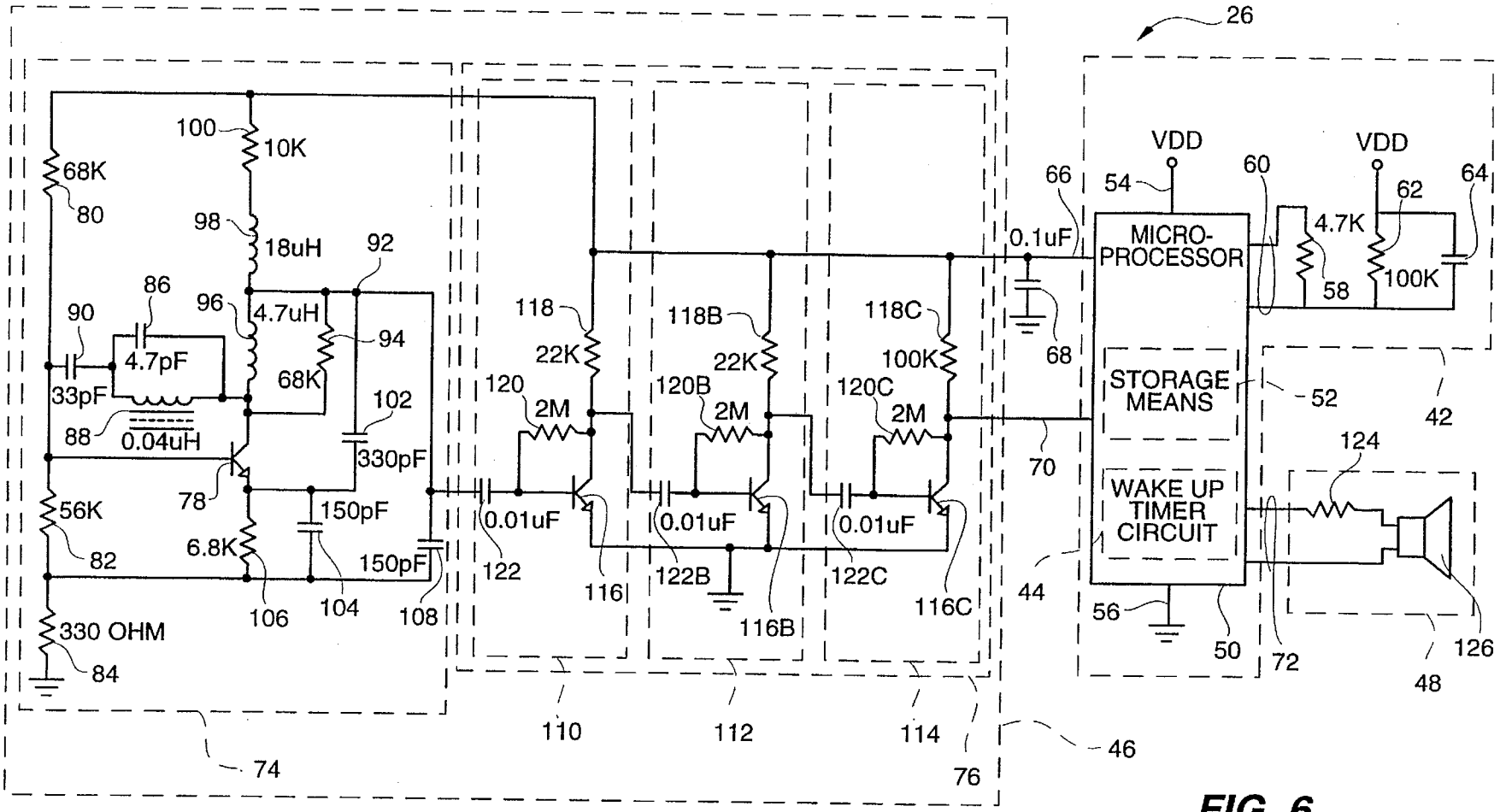
FIG. 6 is a schematic circuit diagram of the internal circuitry of the receiver shown in FIGS. 2 and 3.

FIG. 2 shows a perspective view of the preferred embodiment of the receiver housing 24 enclosing the receiver circuit 26, shown in FIGS. 5 and 6 to be attached to the object that may potentially become lost or misplaced. In order to be attached with as many different types of objects without interfering with the normal use of the object, the size of the receiver housing 24 is kept to a minimum.

The receiver housing 24 has a loop 28 at one end to facilitate the attachment of objects to the receiver housing 24. The loop 28 could be used for attaching a key ring or for threading a length of string or any other similar type object. The receiver housing 24 additionally has an opening 30 through which sound generated from within the receiver housing 24 can readily transmit outside of the receiver housing 24.

FIG. 3 shows a perspective view of the receiver housing 24 shown in FIG. 2 attached to the back of the remote control 10 shown in FIG. 1. The receiver housing 24 could be attached to the back of the remote control 10 by the use of a two sided adhesive pad or something similar. By attaching the receiver housing 24 to the remote control 10, the receiver housing 24 containing the receiver circuit 26 will be located near the remote control 10 in the event it becomes lost or misplaced.

Figure 7:
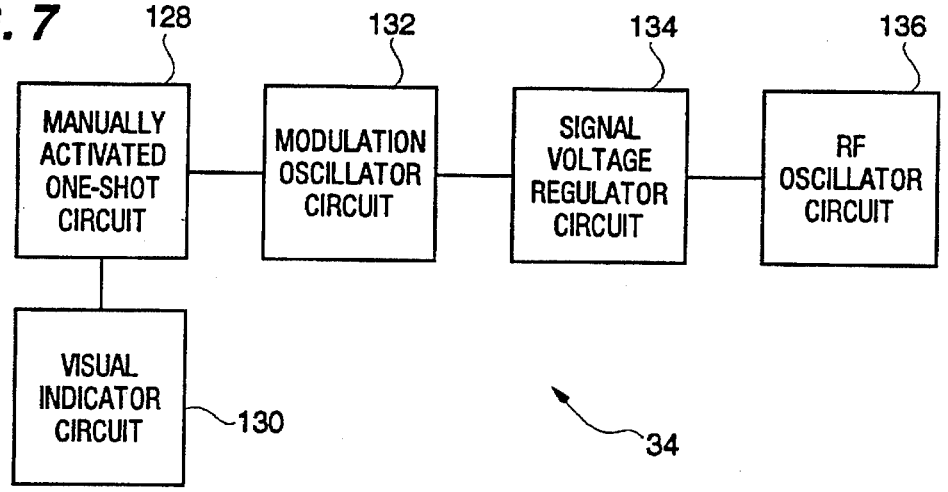
FIG. 7 is a block diagram of the internal circuitry of the transmitter shown in FIG. 4.
Figure 8:
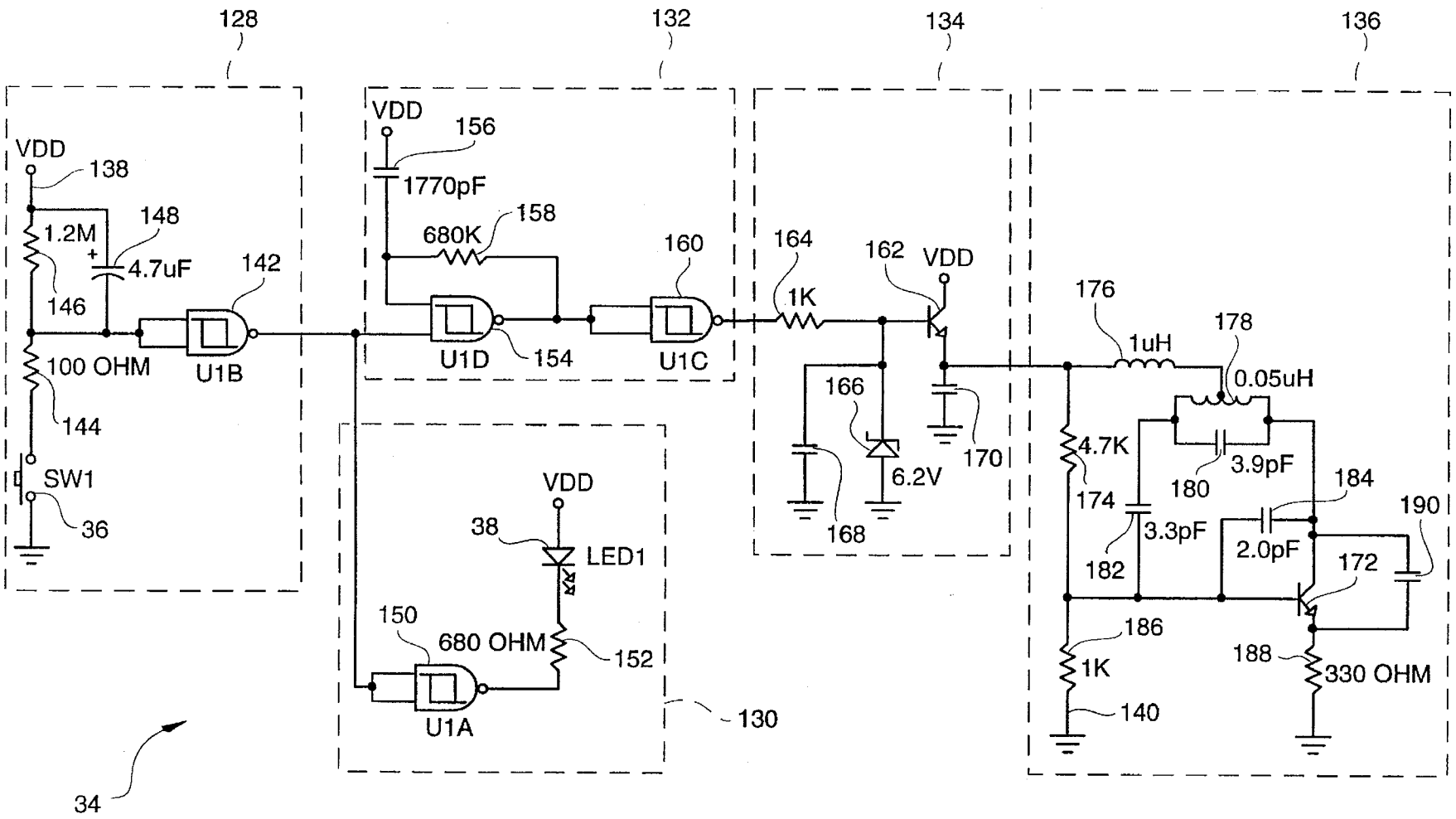
FIG. 8 is a schematic circuit diagram of the internal circuitry of the transmitter shown in FIG. 4.

FIG. 4 shows a perspective view of the preferred embodiment of the transmitter housing 32 containing the transmitter circuit 34, shown in FIGS. 7 and 8, that is used to signal the receiver 24, shown in FIGS. 2 and 3.

The transmitter housing 32 exposes a manually actuated switch 36 and a light emitting diode 38, shown in FIG. 8, which is exposed at the front 40 of the transmitter housing 32. Both the manually actuated switch 36 and the light emitting diode 38 are part of the transmitter circuit 34 located within the transmitter housing 32.

The manually actuated switch 36, when pressed by the user, triggers the transmitter circuit 34 to broadcast a signal used to contact the receiver circuit 26 located within the receiver housing 24. While the transmitter circuit 34 is broadcasting the signal used to contact the receiver circuit 26, the light emitting diode 38 emits light within the visible spectrum for the duration the transmitter circuit 34 is broadcasting the signal.

FIG. 5 shows a block diagram of the receiver circuit 26 located within the receiver housing 24, shown in FIGS. 2 and 3. The receiver circuit 26 includes a control circuit 42 coupled to a wake up timer circuit 44, a wireless signal receiver circuit 46, and an audible signal generator circuit 48.

The wake up timer circuit 44 periodically generates a wake up signal, which is received by the control circuit 42, which instructs the control circuit 42 to activate the wireless signal receiver circuit 46. If while activated, the wireless signal receiver circuit 46 detects the signal broadcast by the transmitter circuit 34, when the manually actuated switch 36 is pressed, the control circuit 42 activates the audible signal generator circuit 48 and deactivates both the wireless signal receiver circuit 46 and the wake up timer circuit 44.

FIG. 6 is a more detailed schematic circuit diagram of the receiver circuit 26 located within the receiver housing 24 shown in FIGS. 2 and 3. The receiver circuit 26 includes a control circuit 42 coupled to a wake up timer circuit 44, a wireless signal receiver circuit 46, and an audible signal generator circuit 48.

The control circuit 42 includes a microprocessor 50 having storage means 52 for storing program instructions and program data. The microprocessor 50 receives power through two supply terminals 54, 56 the first power terminal 54 is connected to the positive voltage supply, labeled VDD, and the second power terminal 56 is connected to the return voltage supply, labeled Ground. The positive voltage supply and the return voltage supply are provided, by a power source, preferably a battery. The power source is not shown.

In the preferred embodiment, the storage means 52 for storing program instruction and program data is implemented using semi-conductor memory. The semi-conductor memory is of the type Random Access Memory (RAM), Read-Only Memory (ROM), or a combination of the both. The type of semi-conductor memory used is dependant on the exact method of implementation. Program instructions preferably would be located in ROM, while program data preferably would be located in both ROM and RAM.

The microprocessor 50 has a resistor 58 located across two input pins 60, with the second of the two input pins 60 coupled to the positive voltage supply via a resistor 62 in parallel with a capacitor 64. The microprocessor 50 determines its internal operating frequency based on the values of the resistors 58, 62 and the capacitor 64 connected to the two input pins 60. The value of the capacitor 64 in the preferred embodiment can vary between 22 pF and 27 pF dependant on the type of microprocessor used.

The wake up timer circuit 44, in the preferred embodiment is implemented within the microprocessor 50. The wake up timer circuit 44 preferably is implemented by program instructions in conjunction with the internal microprocessor architecture. The wake up timer circuit 44 can be generally implemented through the use of a counter or timer. After a set period of time has elapsed the wake up timer circuit 44 signals the microprocessor 50 to activate the wireless signal receiver circuit 46.

The microprocessor 50 activates and deactivates the wireless signal receiver circuit 46 through the use of an output terminal 66 which provides a positive reference voltage to the wireless signal receiver circuit 46. The positive reference voltage essentially provides power for the wireless signal receiver circuit 46. Preferably the wireless signal receiver circuit 46 would be activated for only a fraction of the time the wireless signal receiver circuit 46 would be active if it was powered continuously. The fraction of activation time could be as small as 1/100 and still function very reliably. By only periodically activating the wireless signal receiver circuit 46 for short periods of time, power consumption is significantly reduced. Reducing power consumption is important in allowing smaller batteries to be used, or batteries that operate for a longer period of time, increasing the time between when batteries need to be replaced.

A capacitor 68 is connected between the output terminal 66, which provides a positive reference voltage to the wireless signal receiver circuit 46, and the return voltage supply or ground to reduce signal fluctuations in the positive reference voltage and to provide a degree of noise immunity.

Once activated, the wireless signal receiver circuit 46 is capable of detecting a signal transmitted by the transmitter circuit 34. Upon receipt of a signal transmitted by the transmitter circuit 34, the wireless signal receiver circuit 46 amplifies the signal and outputs the amplified received signal to the microprocessor 50 via an input terminal 70.

Upon receipt of the amplified received signal by the microprocessor 50, the microprocessor 50 activates the audible signal generator circuit 48 using a differential signal over a pair of output terminals 72. The microprocessor 50 disables all non-essential circuitry, including the wireless signal receiver circuit 46 and the wake up timer circuit 44, while the audible signal generator circuit 48 is activated. In this way, further power savings are realized.

The wireless signal receiver circuit 46 includes a tuning circuit 74 and an amplifier circuit 76. The tuning circuit 74 has a single super-regenerative type transistor 78 configured as a common emitter amplifier having both voltage and current gain. The base of transistor 78 is coupled to the positive reference voltage generated by the microprocessor 50 at output terminal 66 via resistor 80. The base of transistor 78 is coupled to ground via resistors 82 and 84, connected in series. The collector of transistor 78 is coupled to the base of transistor 78 via capacitor 86 in parallel with inductor 88, the combination capacitor 86 and inductor 88, in series with capacitor 90. The tuning circuit 74 is tuned by varying the value of capacitor 86. Both the receiver circuit 26 and the transmitter circuit 34 are designed to operate with a carrier frequency in the ultra-high frequency (UHF) radio frequency spectrum, preferably between 300 MHz and 400 MHz.

The collector of transistor 78 is coupled to an output node 92 via resistor 94 in parallel with inductor 96. The output node 92 is coupled to the positive reference voltage, supplied by the output terminal 66 of the microprocessor 50, via an inductor 98 in series with resistor 100. The emitter of transistor 78 is coupled to the output node 92 via capacitor 102. Connected in parallel with capacitor 102 is the parallel combination of capacitor 104 and resistor 106 in series with capacitor 108. The signal generated at the output node 92 is received by the amplifier circuit 76, where the signal is further amplified.

The amplifier circuit 76 comprises a first, second, and third stage of amplification 110, 112 and 114, respectively. The first stage of amplification 110 has a transistor 116 with its collector coupled to the positive reference voltage, supplied by the output terminal 66 of the microprocessor 50, via resistor 118. The base of transistor 116 is coupled to the collector of transistor 116 via resistor 120. The base of transistor 116 is coupled to the signal to be amplified, or in the case of the first stage, the signal generated at the output node 92 of the tuning circuit, via capacitor 122. Capacitor 122 blocks the DC component of the signal at the output node 92, so that only the AC component is amplified. The emitter of transistor 116 is coupled directly to ground.

The second stage of amplification 112 is identical to the first stage of amplification, however it receives its input from the output of the first stage of amplification 110 located at the collector of transistor 116.

The third stage of amplification 114 is similarly identical to the first two stages of amplification, similarly receiving its input from the output of the preceding stage. However, the third stage 114 is different than the first two stages in one way. The third stage has a larger value of resistance coupling the collector of transistor 116C to the positive reference voltage, supplied by the output terminal 66 of the microprocessor 50. The larger value resistor 118C makes the third amplification stage 114 a saturating amplifier. The saturating amplifier produces an output that is suitable for digital signal processing by the control circuit. The output of the third stage of amplification or the amplified received signal is received by the microprocessor 50 via input terminal 70.

The audible signal generator circuit 48 includes a resistor 124 and a piezo ceramic buzzer 126. When the control circuit 42 activates the audible signal generator circuit 48 via the pair of output terminals 72, the piezo ceramic buzzer 126 makes an audible noise the user can follow to the lost or misplaced object. After the audible signal generator circuit 48 emits an audible noise for a set duration of time, the control circuit 42 deactivates the audible signal generator circuit 48 and re-enables the wake up timer circuit 44 and the wireless signal receiver circuit 46.

FIG. 7 shows a block diagram of the transmitter circuit 34 located within the transmitter housing 32, shown in FIG. 4. The transmitter circuit 34 includes a manually activated one-shot circuit 128 coupled to a visual indicator circuit 130 and to a modulation oscillator circuit 132 which is coupled to a signal voltage regulator circuit 134 which is coupled to an RF oscillator circuit 136.

In one preferred embodiment, the one-shot circuit 128, upon the user activating switch 36, generates a single signal lasting approximately 4.5 seconds. The visual indicator circuit 130 illuminates the light emitting diode 38 for the duration of the single signal. The modulation oscillator circuit 132 generates a signal having a frequency of 2.4 kHz and a 50 percent duty cycle, which lasts for the duration of the single signal. The signal voltage regulator circuit 134, regulates the voltage of the signal from the battery voltage to approximately 5.5 volts. The RF oscillator circuit 136 transmits the regulated signal having a carrier frequency between 300 MHz and 400 MHz. The preferred embodiment uses a carrier frequency of 349 MHz.

FIG. 8 is a more detailed schematic circuit diagram of the transmitter circuit 34, shown in FIG. 7, located within the transmitter housing 32 shown in FIG. 4. The transmitter circuit 34 includes a manually activated one-shot circuit 128, a visual indicator circuit 130, a modulation oscillator circuit 132, a signal voltage regulator circuit 134 and an RF oscillator circuit 186.

The transmitter circuit 34 is receives its power from a battery, not shown. The positive terminal of the battery is connected to terminal 138, labeled VDD, of the transmitter circuit 34. The negative terminal of the battery is connected to terminal 140, labeled ground, of the transmitter circuit 34. The preferred embodiment is powered by a standard 9 volt battery.

The user initiates circuit activity by pressing the user actuated switch 36. The inputs of NAND Gate 142 are coupled to ground 140 via the switch 36 in series with resistor 144. The inputs of NAND Gate 142 are coupled to terminal 138, VDD, by resistor 146 in parallel with capacitor 148. The inputs of NAND Gate 142, when the switch is not actuated, are pulled high by resistor 146 coupled to terminal 138, VDD. The output of NAND Gate 142 has a low logic level when the inputs are pulled high. When the switch is pressed, the inputs of NAND Gate 142 are pulled to ground until the switch is released. The output of the NAND Gate 142 generates a high logic level which activates the rest of the transmitter circuit 34. When the switch is released, the inputs of the NAND Gate 142 are pulled high again limited by the rate at which capacitor 148 is charged by resistor 146. When the inputs of the NAND Gate reach a high logic level, the output of the NAND Gate generates a low logic level, deactivating the rest of the circuit. The NAND Gate 142 in the preferred embodiment is a Schmitt Trigger. The output of NAND Gate 142 is coupled to the input of both the visual indicator circuit 130 and the modulation oscillator circuit 132. The output of NAND Gate 142 is coupled to the inputs of NAND Gate 150, of the visual indicator circuit 30. When the output of NAND Gate 142 is high, the output of NAND Gate 150 is low. When the output of NAND Gate 150 is low, current flows from VDD 138, through light emitting diode 38, through resistor 152, causing the light emitting diode 38 to illuminate. Current is prevented from flowing when the output of NAND Gate 150 is high.

The output of NAND Gate 142 is coupled to one of the inputs of NAND Gate 154 of the modulation oscillator circuit 132. The other input of NAND Gate 154 is coupled to VDD via capacitor 156. The other input of NAND Gate 154 is additionally coupled to output of NAND Gate 154 through resistor 158. By providing a feed back path from the output of NAND Gate 154 to one of its inputs, the output of NAND Gate 154 oscillates when the output of NAND Gate 142 is high. The frequency at which NAND Gate 154 oscillates is dependant on the values of resistor 158 and capacitor 156. The output of NAND Gate 154 is buffered and inverted through NAND Gate 160.

The output of NAND Gate 160 is coupled to the input of the signal voltage regulator circuit 134. The input of the signal voltage regulator circuit 134 is coupled to the base of transistor 162 via resistor 164. Additionally coupled to the base of transistor 162 is the anode of zener diode 166. The cathode of zener diode 166 is coupled to ground 140. The zener diode 166 in the preferred embodiment has an avalanche breakdown voltage of 6.2 Volts before the zener diode 166 will conduct to ground 140. This prevents the base of transistor 162 from exceeding a voltage level of 6.2 Volts. When transistor 162 is on, the transistor has a voltage drop from its base to emitter of 0.7 Volts. This produces an output voltage that oscillates from 5.5 V when the transistor is on to 0 Volts when the transistor turns off. The collector of transistor 162 is coupled to VDD 138.

The signal voltage regulator circuit 134, additionally provides for the possible addition of two filtering capacitors 168, 170. The first capacitor 168 couples the base of transistor 162 to ground 140. The second capacitor 170 couples the emitter of transistor 162 to ground 140. In one preferred embodiment both capacitors 168, 170 are open.

The RF oscillator circuit 136 receives the output of the signal voltage regulator circuit 134. The output of the signal voltage regulator circuit 134 is coupled to the base of transistor 172 via resistor 174. The tuning of the carrier frequency the transmitter circuit 34 uses is accomplished via a tank circuit coupled to both the base of transistor 172 and the collector of transistor 172.

The tank circuit comprises a fixed inductor 176, a variable inductor 178 and three capacitors 180, 182 and 184. The fixed inductor 176 has one lead coupled to the output of the signal voltage regulator circuit 134 and the other lead of the fixed inductor 176 is coupled to the variable inductor 178 at a variable point along the length of its wire turnings. Coupled in parallel with the variable inductor 178 is capacitor 180. One lead of the variable inductor 178, coupled in parallel with the capacitor 180, is coupled to the base of transistor 172 via capacitor 182. The other lead of the variable inductor 178 is coupled to the collector of transistor 172. The collector of transistor 172 is coupled to the base of transistor 172 via capacitor 184.

The base of transistor 172 is coupled to ground 140 via resistor 186. The collector of transistor 172 is coupled to ground 140 via resistor 188. The RF oscillator circuit 136 additionally provides for a filtering capacitor 190 coupling the collector of transistor 172 with the emitter of transistor 172. In the preferred embodiment capacitor 190 is open.

From the foregoing description, it will be apparent that the system for locating an object including a transmitter 32 and a receiver 24 of the present invention has a number of advantages, some of which have been described above and others of which are inherent in the invention. Also it will be understood that modifications can be made to the system for locating an object described above without departing from the teachings of the invention.

I claim:

1. A system for locating an object comprising, a transmitter and a receiver, the receiver being capable of being coupled to the object to be located such that the receiver is continuously within the proximity of the object, and the transmitter, when activated, outputting a transmitted signal which is detected by the receiver which, as a result of receiving the transmitted signal, generates an audible signal, the improvement residing in the receiver comprising:

a control circuit;

a wake up timer circuit coupled to said control circuit, for periodically generating a wake up signal;

a wireless signal receiver circuit coupled to said control circuit, said wireless signal receiver circuit being periodically activated by said control circuit when said control circuit receives said wake up signal from said wake up timer circuit, for generating a detect signal when said wireless signal receiver circuit receives the transmitted signal from the transmitter;

an audible signal generator circuit coupled to said control circuit, for generating an audible signal when the control circuit activates said audible signal generator circuit upon receipt of said detect signal from said wireless signal receiver circuit; and said control circuit disabling said wake up timer circuit and said wireless signal receiver circuit when said audible signal generator circuit is generating said audible signal.

2. The system of claim 1, wherein said control circuit activates the audible signal generator circuit upon receipt of said detect signal from said wireless signal receiver circuit for a finite duration and, upon termination of said finite duration, said control circuit enables said wake up timer circuit and said wireless signal receiver circuit.

3. The system of claim 1, wherein the interval between consecutive periodically generated wake up signals is less than the duration of the transmitted signal from the transmitter.

4. The system of claim 1, wherein said control circuit includes a positive reference voltage signal coupled to said wireless signal receiver circuit and said wake up timer circuit, said control circuit disabling said wireless signal receiver circuit and said wake up timer circuit by uncoupling said positive reference voltage from said wireless signal receiver circuit and said wake up timer circuit.

5. The system of claim 1, wherein said control circuit includes a microprocessor having a storage means for storing program instructions and program data.

6. The system of claim 5, wherein said wake up timer circuit is incorporated into said microprocessor.

7. The system of claim 1, wherein said audible signal generator circuit includes a piezo ceramic buzzer.

8. The system of claim 1, wherein said wireless signal receiver circuit includes a tuning circuit and an amplifier circuit.

9. The system of claim 8, wherein said tuning circuit includes a first capacitor in series with a first inductor in parallel with a second capacitor and whereby changing the value of the second capacitor will tune the receiver to a different carrier frequency.

10. The system of claim 8, wherein said amplifier circuit includes a first, a second and a third stage of amplification.

11. The system of claim 10, wherein said third stage of amplification is a saturating amplifier for generating an output suitable for digital signal processing.

12. A method of conserving power within a receiver, used in conjunction with a transmitter for generating a transmit signal, for locating a lost object, where said receiver comprises; a control circuit, a wake up timer circuit, a wireless signal receiver circuit and an audible signal generator circuit comprising the steps of:

generating a periodic wake up signal using the wake up timing circuit;

activating the wireless signal receiver circuit in response to receipt of said wake up signal by said control circuit for a set period of time to detect the presence of the transmit signal from the transmitter;

generating a detect signal when the presence of the transmit signal is detected;

activating the audible signal generator circuit upon receipt of said detect signal by said control circuit and disabling the wake up timer circuit and the wireless signal receiver circuit; and deactivating, after a preset period of time, the audible signal generator circuit, and enabling the wake up timer circuit and the wireless signal receiver circuit.

* * * * *